US005813568A

United States Patent [19]

Lowing

[11] Patent Number: 5,813,568

[45] Date of Patent: Sep. 29, 1998

[54] DISPENSING MACHINE FOR NEWSPAPERS AND MAGAZINES

[75] Inventor: C. Rankin Lowing, Mobile, Ala.

[73] Assignee: DPC International, Inc., Dublin, Ireland

[21] Appl. No.: 623,998

[22] Filed: Mar. 29, 1996

[51] Int. Cl.[6] ..... G07F 11/00

[52] U.S. Cl. ..... 221/6; 221/14; 221/17; 221/258; 221/279; 221/195

[58] Field of Search ..... 221/6, 14, 17, 221/18, 227, 226, 258, 279, 280, 195

[56] References Cited

U.S. PATENT DOCUMENTS

| | | | |
|---|---|---|---|
| 2,137,490 | 11/1938 | Harvey | 312/57 |
| 2,800,251 | 7/1957 | Abendschein | 221/211 |
| 2,876,884 | 3/1959 | Ray | 194/10 |
| 3,685,691 | 8/1972 | Charest et al. | 221/225 |
| 4,298,140 | 11/1981 | Owens | 221/232 |
| 4,473,172 | 9/1984 | Reynolds | 221/213 |
| 4,770,321 | 9/1988 | Anderson | 221/100 |
| 4,821,916 | 4/1989 | Dewaele | 221/13 |
| 5,067,605 | 11/1991 | Gordon | 221/227 |
| 5,199,599 | 4/1993 | Shade | 221/226 |
| 5,305,913 | 4/1994 | Shade | 221/226 |
| 5,373,963 | 12/1994 | Hsu | 221/17 |
| 5,400,919 | 3/1995 | Gomm | 221/195 |
| 5,553,738 | 9/1996 | Roselli | 221/195 |

FOREIGN PATENT DOCUMENTS

| | | | |
|---|---|---|---|
| 0685827 | 1/1995 | European Pat. Off. | G07F 11/04 |
| 2117786 | 10/1972 | Germany | G07F 11/42 |
| 24 37 648 | 2/1996 | Germany | 221/279 |
| WO 9012377 | 10/1990 | WIPO | 221/279 |

*Primary Examiner*—H. Grant Skaggs
*Attorney, Agent, or Firm*—Keaty Paten Firm

[57] ABSTRACT

The invention relates to vending machines for dispensing of a single copy of a printed publication, such as a newspaper or a magazine. The vending machine is self-contained, enclosing a power source, a driving motor and a control unit for operation of the dispensing mechanism. A stack of folded newspapers, or magazines, is placed in an upright position on a platform bearing plate and is retained in an upright orientation by a support plate which slides along the top surface of the platform bearing plate, moving the newspapers closer to a dispensing chute formed in a front part of the vending machine housing. One or more metering breaks are mounted on a top surface of the platform plate adjacent to the dispensing edge of the platform bearing plate to facilitate separation of a single copy of the newspaper prior to dispensing. A sensor mounted in the upper portion of the dispensing chute transmits a signal to the motor, deactivating operation of the motor and further advancement of the support plate along the platform bearing plate after one copy of the newspaper drops into the chute. A limit switch operationally connected to the motor prevents acceptance by the vending machine of additional payment after an entire supply of the publications in the vending machine has been dispensed.

11 Claims, 4 Drawing Sheets

DISPENSING MACHINE FOR NEWSPAPERS AND MAGAZINES

BACKGROUND OF THE INVENTION

The present inventing relates to vending machines, and more particularly to a machine for dispensing a single copy of media units, or publications at a time.

Commercial newspaper and magazine dispensing machines are located in the lobbies of public buildings, or street corners at locations which allow maximum exposure of the newspapers and magazines to the public. Conventionally, the dispensing machines comprise a storage housing which is closed by a spring-operated door that can be opened by deposit of a coin into the slot of the housing which activates the spring release mechanism. Such design suffers from major drawbacks, one of which is inability of the vending machine owner to control the number of copies which can be removed from the vending machine by one buyer. For example, the buyer can deposit the money suitable for the purchase of one unit of the periodical and after the spring door latch is released, remove several copies of the newspaper from the vending machine, which results in a direct financial loss to the vending machine operator.

To solve this problem, various designs of vending machines were suggested. These machines were invented for the purpose of restricting access of the buyer to the entire inventory of the vending machine. One of such prior solutions is shown in U.S. Pat. No. 5,400,919 issued on Mar. 28, 1995. In accordance with that patent, folded newspapers are advanced along an inclined platform by a push plate which supports the back of the folded newspaper. Individual copies of the newspapers are advanced to a vend position by operation of a frictional roller which engages the foremost single copy and brings it into alignment with a hopper plate descending downwardly from the platform. After a customer pays for a copy of the newspaper, a single copy is allowed to fall through the hopper to an access slot for recovery by the customer. A sensor positioned in the hopper wall sends a signal to a control mechanism to allow actuation of the frictional rollers and depositing of the next copy into the vending position, from which the next customer can retrieve a copy after the trap door opens. Such a design, while being an improvement over prior designs, still suffers from some disadvantages. For example, the trap door from which the fold of the newspaper rests while the newspaper is in the vending position, is located very close to the access opening from which the newspaper is withdrawn by the buyer. Additionally, the entire inventory of the media units is positioned very close to the vending position; the design requires provision of a special bailer that acts in combination with a cam/step motor unit to retain the forwardmost newspaper in a generally vertical orientation. These features in the design in accordance with '919 patent are complex, while the entire machine is relatively expensive to manufacture.

The present invention contemplates elimination of drawbacks associated with a vending machines and provision of an apparatus suitable for dispensing newspapers or magazines one copy at a time, which is simple in operation and inexpensive to manufacture.

SUMMARY OF THE INVENTION

It is, therefore, an object of the present invention to provide a vending machine for dispensing of a single copy of media unit, or publication.

It is another object of the present invention to provide a media unit dispensing machine which is self-contained, so as to allow positioning of the unit indoors or outdoors, without connection to a source of AC power.

It is a further object of the present invention to provide a vending machine which is designed to eliminate theft of newspapers and magazines from the storage container.

These and other objects of the present invention are achieved through a provision of a self-contained vending apparatus which comprises a hollow housing having a dispensing chute in a front part thereof. The dispensing chute defines a dispensing channel and is formed by an inner wall and an outer wall. A platform bearing plate is securely connected to a top edge of the inner wall, with the connection line defining a dispensing edge. A stack of folded newspapers, or other publications, is placed on the platform bearing plate and is supported in an upright position by a support plate which slidably moves along the top surface of the platform bearing plate and retains the stack of folded newspapers in a generally upright orientation.

A gear motor is mounted in the housing and is operationally connected to the support plate to facilitate movement of the newspapers towards the dispensing edge in response to a signal received from a central unit after payment for a single copy of the publication has been made. An anti-theft bar is mounted transversely in the uppermost end of the dispensing channel. The anti-theft bar is normally open, but will be closed in response to an attempt to tilt the housing to a degree in access of a predetermined value. The anti-theft bar is controlled by a mercury tilt switch.

Mounted below the anti-theft bar is a limit switch assembly which detects movement of a single copy of the publication into the dispensing channel and transmits the received signal to the motor. Once this copy of the newspaper is detected by the limit switch sensor, the motor is deactivated to prevent any further advancement of the support plate along the platform bearing plate. As a result, no further copies of the newspapers are dispensed until such time as further payment is made.

The vending machine is equipped with an independent power source allowing operation of the vending machine independently from a source of AC power. To facilitate separation of a single copy of the newspaper from the stack of folded newspapers, two or more metering breaks are mounted on the top surface of the platform plate adjacent the dispensing edge. The metering breaks have inclined upper surfaces which cause slight compression of the forwardmost newspaper and separate the single copy from the rest of the stack. A retractable spring plunger controls rotation of a lead screw which causes advancement of the support plate when the plunger is moved out of engagement with the lead screw, the support plate can be moved back to an inventory loading position to allow the vendor to restock the supply of newspapers.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
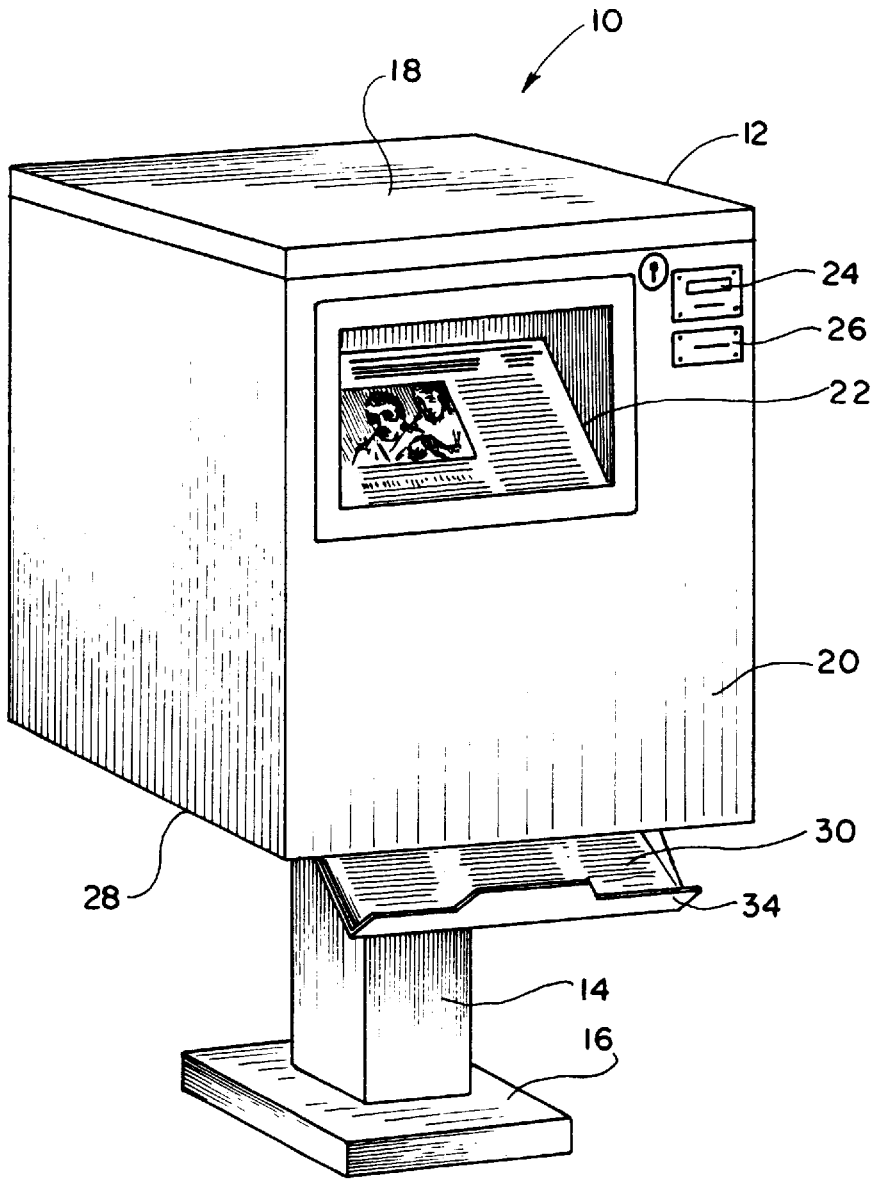
FIG. 1 is a perspective view of a vending machine in accordance with the present invention.

Referring now to the drawings in more detail, numeral 10 designates a vending machine in accordance with the present invention. The vending machine 10 comprises a hollow housing 12 supported by a pedestal 14 on a weighted base 16. An access door 18 is formed in the top wall of the housing 12, the access door 18 being formed as a cap resting on the upper edges of the vertical walls. If desired, a mechanical prop arm can be used to hold the door 18 to allow easy access to the vendor to the interior of the housing and positioning of a number of newspapers or magazines inside the housing. The front wall 20 of the housing 12 is provided with a transparent window 22 which allows the buyer to view the publication title and a portion of the front page of the publication stored in the housing 12.

A credit card receiving opening 24 is formed in the front wall 20 of the housing 12 to allow the buyer to use his credit card or other similar smart card for payment, if desired. An alternative payment by coins can be made by using a coin receiving slot 26 mounted in a spaced relationship with the smart card receiving slot 24.

Extending downwardly from the bottom wall 28 of the housing 12 is an inner wall 30 of the chute 32, the wall 30 extending through an elongated transverse opening (not shown) formed in the bottom plate 28. The inner plate 30 is provided with an upwardly turned lip 34 which forms a U-shaped channel 36 with the chute plate 30. A bottom plate 38 of the channel 36 is wide enough to accommodate a publication dispensed through the use of the vending machine 10. It is preferred that the width of the channel 36 be sufficient to accommodate daily newspapers, as well as thicker Sunday newspapers.

Figure 2:
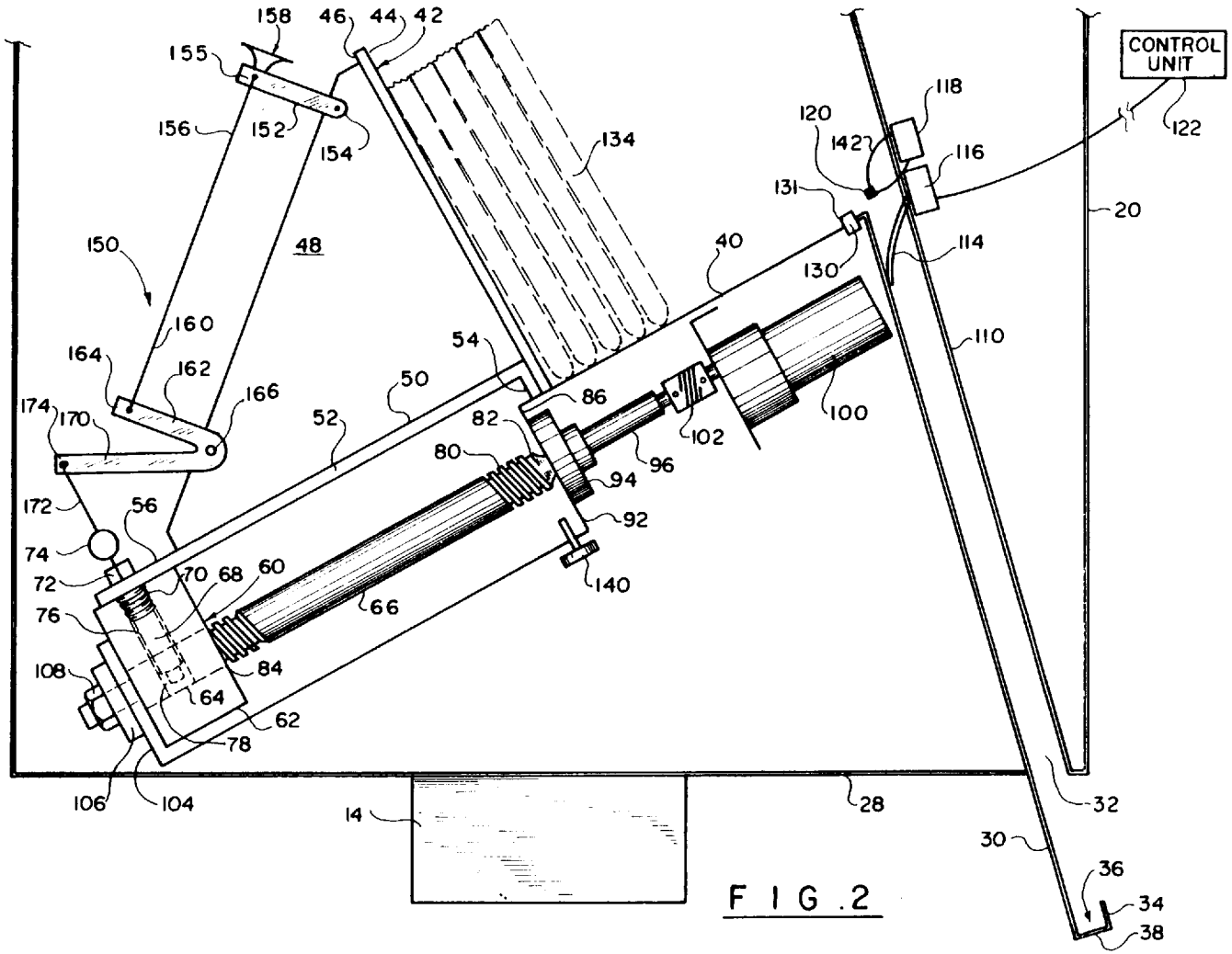
FIG. 2 is a schematic view of the operating mechanism of the vending machine in accordance with the present invention.
Figure 4:
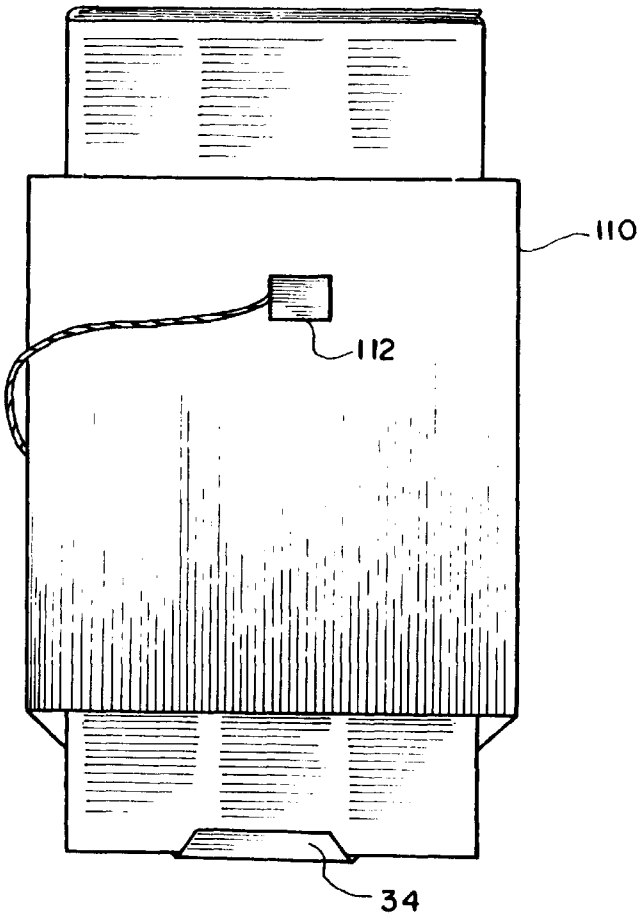
FIG. 4 is a detail view showing a switch assembly mounted on the outer chute plate.

Turning now to FIG. 2, the operational mechanism of the vending machine 10 in accordance with the present invention is illustrated. As can be seen in the drawing, the operational part of the vending machine 10 comprises an inclined bearing plate, or platform plate 40 which has a smooth upper surface to allow movement of the newspapers thereon without damage to the newspaper pages. Extending upwardly at a right angle to the platform plate 40 is a support, or push plate 42 which is similarly formed with a smooth surface to allow support of the newspapers in an upright position without to damaging to the pages. The push plate 42 has a support front surface 44 and a rear surface 46. Fixedly attached to the rear surface 46 is a buttress plate 48 which helps to support the weight of the publications leaning against the surface 44. If desired, there can be a pair of buttress plates 48 secured to the rear surface 46 of the push plate 42.

The buttress plate 48 has a bottom edge 50 which rests on an attachment bracket 52, with one end 54 of the bracket 52 resting on the platform 40 behind the plate 42, and with the opposite end 56 secured to the top of the retractable plunger assembly 60.

The plunger assembly 60 comprises an enclosure 62 provided with a central opening 64, through which a lead screw 66 extends. Resting on top of the screw within the enclosure 62 is a plunger body 68 which is retained in a contact relationship with the surface of the screw 66 by a compression spring 70.

Fixedly attached to the top surface of the plunger 68 is an elongated rod 72 which extends outwardly from the enclosure 62 above the attachment bracket 52. A gripping ring 74 is secured to the rod 72 to allow rotation of the plunger body 68 to move it out of engagement with the lead screw 66.

The plunger body 68 is provided with external screws 76 to allow engagement of the plunger 68 within an internally threaded sleeve 78. By grasping the ring 74, the user can rotate the plunger body 68, moving it out of engagement with the lead screw 66, thereby allowing backward movement of the push plate 42 along the platform 40. If desired, the apparatus 10 can be provided with a pivotal arm 150 which comprises an attachment rod 152 pivotally attached to the buttress 48 at 154. The rod 152 extends upwardly from the buttress plate 48 and is provided with an opening 155 through which a pulling rod 156 extends. A hand pull 158 is attached to one end of the rod 156 to allow grasping of the pull 158 by the vendor, The opposite end 160 of the pulling rod 156 is pivotally engaged with a first pivot arm 162 at a pivot point 164. The first pivot arm 162 is pivotally connected, such as at 166 to the buttress plate 48 a distance from the first pivotal attachment point 154.

A second arm 170 is also connected to the buttress plate 48 at pivot point 166 and, at the same time, to the first pivot arm 162.

An opposite end of the second arm 170 carries an attachment rod 172 in pivotal engagement, such as shown at 174. A free end of the rod 172 is securely attached to the ring 74, such that the pulling action exerted by a vendor on the handle 158 will be transmitted through the rod 156 to the arms 162, 170 and to the rod 172. This arrangement allows the vendor to lift the plunger body 68 from its engagement with the lead screw 66 from a convenient position at the front of the housing 12. As a result of the pulling action, the support plate 42 can be moved to the rear of the housing along the platform bearing plate 40 to a loading position shown in FIG. 2. The supply of publications can then be replenished.

The lead screw 66 is an elongated screw provided with external threads 80 which extend substantially along entire body of the screw 66. Only two portions of the screw threads 80 are shown for clarity. The lead screw 66 has a forward end 82 and a back end 84. The forward end 82 has a reduced diameter to allow the end 82 to pass through a corresponding opening formed in the downwardly depending part 86 of the platform plate 40. A U-shaped supporting bracket 90 engages the lead screw 66 about its opposing ends. The end 82 passes through an opening formed in an upwardly extending part 92 of the bracket 90 and is engaged by a bearing 94 on the exterior surface of the screw. An outwardly extending portion 96 of the lead screw 66 is operationally connected to a gear motor 100 through a suitable coupling 102.

The opposite end 84 of the lead screw 66 passes through the plunger assembly 64 and through an upwardly turned part 104 of the support bracket 90. The outwardly extending part of the lead screw 66 is engaged by a suitable bearing 106 and secured in place by a nut 108.

The front wall 20 of the housing 12 carries a front wall 110 of the chute 30. Securely attached to the wall 110 is a limit switch assembly 112 which comprises a sensor bar 114 connected by a suitable wiring to a switch box 116. If desired, the sensor bar 114 can be substituted by an optical sensor, or a photo element which would allow detection of movement of a newspaper through the chute 32. The limit switch assembly 112 is operationally connected to a mercury tilt switch 118 and to an anti-tamper bar 120. The switch assembly 112, as well as the mercury tilt switch 118, are also operationally connected, by suitable wiring to a control unit 122 which controls operation of the device during the vending process. Even though not shown in the drawing, it will be appreciated by those skilled in the art that the motor 100 is also operationally connected to the control unit 122 by suitable wiring. The anti-tamper bar 120 is normally open , and closes if an attempt is made to override the controls of the apparatus 10. For example, if a potential vandal tries to shake or tilt the housing 10 to a degree greater than a predetermined value, a mercury tilt switch 118 will send a signal to the mechanism operating the anti-tamper bar 120, which will cause the bar to move down and close the electrical circuit. The circuit will stay closed with the anti-tamper bar 120 down, for a discrete amount of time, for example 20 seconds. It is envisioned that this time is sufficient to discourage any tampering action by vandals.

As will be appreciated by those skilled in the art, the control unit 122 is shown in a schematic view in FIG. 2. The control unit 122, which houses the electrical and electronic control means for operation of the apparatus 10, can be mounted inside or outside of the housing 12, as desired.

Figure 3:
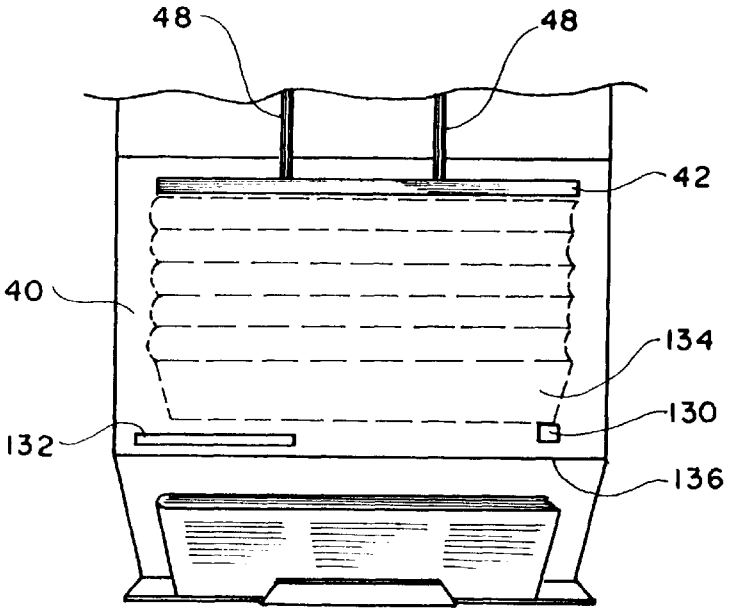
FIG. 3 is a detail top view of the platform and metering break on the vending machine in accordance with the present invention.
Figure 6:
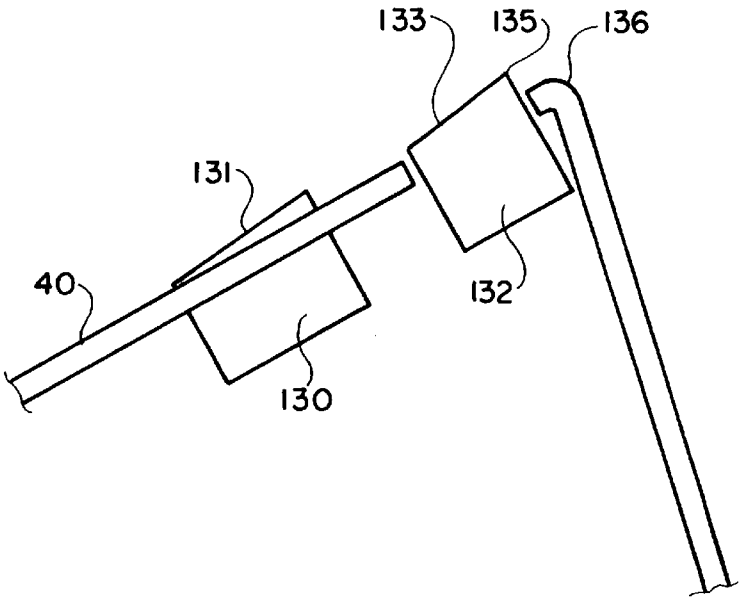
FIG. 6 is a schematic cross-sectional view showing the inclined upper surfaces of the metering breaks.
Figure 5:
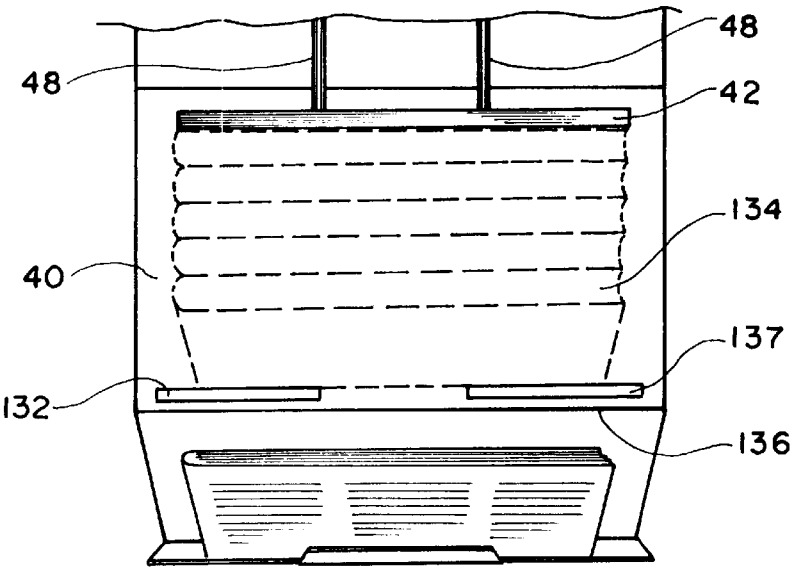
FIG. 5 is a detail view showing an alternative embodiment of the metering breaks, particularly adapted for use with thin publications.

Turning now to FIGS. 3, 5 and 6, the platform plate 40 is shown in more detail. As can be seen in the drawing, the platform plate 40 has a pair of metering breaks 130 and 132 mounted on its upper surface. The metering break 130 is comprised of a solid body having an inclined upper surface 131 (see FIG. 6) forming a slightly elevated surface along which the newspapers 134 travel prior to dispensing. When the newspapers move closer to the metering break 130, the elevated upper surface 131 causes slight compression of the loosely folded newspaper, assisting in separation of a single newspaper for vending.

The metering break 132 comprises an elongated bar which is positioned immediately adjacent an edge 136 of the chute wall 30. The metering break 132 is preferably placed in a parallel relationship to the edge 136 adjacent to the side of the platform plate 40 along which the first fold of the newspaper slides. As can be best seen in FIG. 6, the metering break 132, similar to the metering break 130 is provided with an inclined upper surface 133 and is mounted with its uppermost edge 135 immediately adjacent to the dispensing edge 136. During tests, it became evident that the metering break 132 can be positioned very close to the dispensing edge 136, up to a distance of 1 mm therefrom. It was also noticed that the angle of the incline of the surface 131 can be as little as 5 degrees in relation to the top surface of the plate 40, while the incline of the surface 133 can be as great as 11 degrees in relation to the upper surface of the plate 40. The use of the metering breaks 130 and 132 proved particularly beneficial with multiple-page newspapers, such as Sunday editions. Of course, it will be apparent to those skilled in the art that a metering break, such as break 132, can extend in a parallel relationship along substantially entire length of the edge 136, if desired.

Turning now to FIG. 5 an alternative embodiment of the present invention is shown. This embodiment illustrates the use of a pair of elongated metering breaks 132 and 137 which are positioned on a top surface of the plate 40 in a spaced-apart relationship. The metering break 137 is identical to the metering break 132, except it is suggested that the metering break 137 be positioned slightly farther away from the edge 136, so as to contact the loose side of the newspaper, before the partially folded side of the newspaper contacts the metering break 132. The distance from the edge 136 can be in the order of 25 mm. Such a design may be particularly helpful in use with relatively thin publications, such as thin local papers, magazines, and the like. The sizes of the metering breaks can vary, with one of the designs incorporating a metering break 130 which has the width of 9/16 of an inch, and a length of ¾ of an inch. The metering breaks 132 and 137 can have an exemplary dimensions of 4 inches in length and 7/16 in width.

The apparatus 10 is further provided with a means for terminating the vending process after the entire inventory of the publications have been exhausted. Such limiting means comprises a limit switch 140 mounted on the bracket 90. When the plunger unit 60 reaches the limit switch 140 and it engages the sensor bar 142, the signal will be transmitted to the control unit 122, which will stop the vending machine 10 from accepting further payments.

During loading of the inventory into the housing 12, the vendor uses a special key to open the access door 18 which allows the vendor access to the entire working mechanism of the apparatus 10. The vendor rotates the ring 74, or suitable equivalent thereof, to retract the plunger unit 68 from its engagement with the lead screw 66. The push plate 42 can then be moved to the rear of the enclosure 12 similar to a position shown in FIG. 2.

In the embodiments of the present invention which incorporate the pivotal arm 150, the vendor pulls on the handle 158, transmitting an upwardly directed force on the rod 172 to liberate the lead screw 66 and allow movement of the support plate 42 into a position shown in FIG. 2.

Newspapers are then loaded, with the main fold resting on the plate 40, in a manner similar to that shown in FIG. 2. The plunger body 68 is then rotated to re-engage with the lead screw 66 and to remain in that position due to the force of the compression spring 70. The vendor checks the control unit 122 to make the necessary adjustments to reflect the cost of the media unit positioned in the housing 12. The access door 18 is then closed, and the apparatus 10 is ready for dispensing of units to the purchasing public.

A buyer deposits the necessary amount of coins into the slot 26 or uses a credit card, or smart card by sliding it within the slot 24. The card reader assembly (not shown) is mounted in the housing 10 and is controlled by the control unit 122. Once the exact amount of money is deposited or acknowledged by the control unit 122, the gear motor 100 is energized, transmitting torque through the coupling 102, to the lead screw 66. The rotation of screw 66 will cause movement of the plunger assembly 60 and of the support plate 42.

The stack of newspapers will then advance along the platform 40 until such time as the forwardmost newspaper 134 reaches the metering break 130. A slight compression is created on the bottom edge of the newspaper when the newspaper is moved along the upwardly inclined surface 132 of the metering break 130. This movement causes separation of a single newspaper from the stack of papers, with the separation being further facilitated by the metering break 132 (or metering breaks 132, 137, as the case may be).

As the newspaper moves over the edge 136 into the chute channel 32, it touches the sensor bar 114 (or is detected by an optical element) of the limit switch assembly 112. As a result, a signal is transmitted to the control unit 122 that one newspaper has been dispensed into the chute opening 32. A signal is transmitted to the motor 100, de-energizing it until such time as the next payment is made. The newspaper that falls through the chute 32 descends along the inner plate 30, sliding into the bottom portion 38 of the access channel 36. The buyer then withdraws the newspaper by slightly lifting it to clear the upwardly turned lip 34.

The apparatus for dispensing media units in accordance with the present invention prevents unauthorized access to the entire inventory of the housing 12, by dispensing one media unit at a time. Since the normally open anti-tamper bar 120 is positioned in proximity to the edge 136 of the dispensing chute 32, and the chute itself is made relatively narrow to allow passing of only a single newspaper, an unauthorized person cannot obtain access to the interior of the housing 12 and reach into the chute 32. The vending machine 10 in accordance with the present invention is self contained, as it is powered by a battery (not shown) or by a solar power unit (not shown) which is incorporated into the operational system of the vending machine 10. As a result, the vending machine 10 can be positioned indoors, or outdoors, to accommodate various needs of the vendor and not requiring connection to municipal electrical lines.

Various materials may be employed for manufacturing of the vending machine 10. For example, the metering breaks 130, 132 and 137 can be provided with bead blasted aluminum surface, while the platform plate 40 can be made with a polished smooth surface, for example from a chrome plated metal. The lead screw 66 can be made metal or plastic, while the plunger assembly can be manufactured from strong plastic, or other materials having suitable physical characteristics.

Many changes and modifications can be made in the design of the present invention without departing from the spirit thereof. I, therefore, pray that my rights to the present invention be limited only by the scope of the appended claims.

I claim:

1. A vending apparatus for dispensing a single copy of a media unit, comprising:

a platform plate having an upper surface for supporting a plurality of media units;

a support plate slidably movable along said platform plate, said support plate retaining said media units in an upright position;

a driving means operationally connected to said support plate for advancing said support plate along said platform plate;

a dispensing channel formed adjacent a forward edge of said platform plate;

a means mounted on said platform plate for separating a single forward copy of said media unit prior to movement of the single copy into the dispensing channel, said separating means comprising at least one metering break having an upwardly inclined upper surface extending above said platform plate a distance from said forward edge of the platform plate, said at least one metering break causing compression of an edge of the forward copy of said media unit contacting said inclined upper surface as the forward copy of the media unit is advanced along said platform plate;

a sensor means mounted in an uppermost end of said dispensing channel for detecting movement of the single copy of the media unit into the dispensing channel, said sensor means transmitting a signal to said driving means to terminate advancement of said support plate when the single copy of the media unit drops into the dispensing channel.

2. The apparatus of claim 1, wherein said separating means further comprises a second metering break member, said second metering break member being positioned a distance from said at least one metering break member and in immediate proximity to said forward edge of the platform plate.

3. The apparatus of claim 1, wherein said sensor means comprises a sensor bar extending transversely in said dispensing channel, said sensor bar transmitting a signal to a switch member when the single copy of the media unit drops into said dispensing channel.

4. The apparatus of claim 1, further comprising means for deactivating operation of said driving means after an entire supply of said media units resting on said platform plate has been dispensed.

5. A vending apparatus for dispensing a single copy of folded newspapers, comprising:

a platform plate having an upper surface for supporting a plurality of folded newspapers;

a support plate slidably movable along the platform plate, the support plate retaining a stack has folded newspapers in an upright position;

a driving means operationally connected to said support plate for advancing the support plate along the platform plate;

a dispensing channel formed adjacent a forward edge of the platform plate;

a means mounted on said platform plate for separating a single newspaper from a stack of newspapers prior to movement of the single newspaper into the dispensing channel, said separating means comprising a first metering break member having an upwardly inclined upper surface extending above said platform plate a distance from a forward edge of the platform plate, said first metering break causing compression of an edge of a newspaper contacting said inclined upper surface as the newspaper moves along the platform plate, and a second metering break member positioned a distance from said first metering break member, in immediate proximity to the forward edge of the platform plate; and a sensor means mounted in an uppermost end of said dispensing channel for detecting movement of the single copy of the newspaper into the dispensing channel, said sensor means transmitting a signal to said driving means to terminate advancement of the support plate, said sensor means comprising a sensor bar extending in said dispensing channel for transmitting a signal to a switch member when the single copy of the newspaper drops into the dispensing channel.

6. The apparatus of claim 5, further comprising a means mounted above said sensor bar in the dispensing channel for activating the driving means in response to acceptance of payment for the single copy of the newspaper by the vending apparatus.

7. The apparatus of claim 5, further comprising means for deactivating operation of the driving means after an entire stack of newspapers resting on said platform plate has been dispensed.

8. A self-contained vending apparatus for dispensing newspapers one at a time, comprising:

a hollow housing having a dispensing chute in a front part thereof said chute defining a dispensing channel;

a platform plate securely connected to a wall of said dispensing chute;

a support plate slidably movable along a top surface of the platform plate and retaining a stack of folded newspapers in a generally upright position;

a driving means for advancing said support plate along said platform plate, the driving means comprising a motor operationally connected to one end of a drive screw, a plunger assembly operationally connected to a second end of said drive screw, said support plate being operationally connected to the plunger assembly in a force-receiving relationship;

a means mounted on the platform plate for separating a single forward copy of the newspaper prior to movement of the singly copy into the dispensing chute, said separating means comprising a first metering break member having an upwardly inclined upper surface which extends above the platform plate a distance from a forwardmost edge of the platform plate, said first metering break causing compression of an edge of the newspaper contacting said inclined upper surface as the newspaper moves along the platform plate, and a second metering break member positioned a distance from said first metering break member, in immediate proximity to the forwardmost edge of said platform plate; and a sensor means mounted in an uppermost end of the dispensing chute for detecting movement of the single copy of the newspaper through the dispensing chute, said sensor means transmitting a signal to the driving means to terminate advancement of the support plate and dispensing of a next copy of the newspaper when the single copy of the newspaper drops into the dispensing channel.

9. The apparatus of claim 8, wherein said sensor means comprises a sensor bar extending transversely in said dispenser chute, the sensor bar transmitting a signal to a switch member when a single copy of the newspaper drops into the dispensing chute.

10. The apparatus of claim 8, further comprising means for deactivating operation of the driving means after an entire supply of the newspapers resting on the platform plate has been dispensed, said deactivating means comprising a limit switch operationally connected to a control means mounted inside said housing.

11. A self-contained vending apparatus for dispensing newspapers one at a time, comprising:

a hollow housing having a dispensing chute in a front part thereof said chute defining a dispensing channel;

a platform plate securely connected to a wall of said dispensing chute;

a support plate slidably movable along a top surface of the platform plate and retaining a stack of folded newspapers in a generally upright position;

a driving means for advancing said support plate along said platform plate, the driving means comprising a motor operationally connected to one end of a drive screw, a plunger assembly operationally connected to a second end of said drive screw, said support plate being operationally connected to the plunger assembly in a force-receiving relationship, wherein said plunger assembly is operationally connected to a pivotal arm assembly secured to said plunger assembly, and having a free end adapted for gripping by a user, so as to move the plunger assembly out of engagement with said drive screw;

a means mounted on the platform plate for separating a single forward copy of the newspaper prior to movement of the single copy into the dispensing chute, said separating means comprising a first metering break member having an inclined upper surface which extends above the platform plate and a second metering break member positioned a distance from said first metering break member, in immediate proximity to a forwardmost edge of said platform plate; and a sensor means mounted in an uppermost end of the dispensing chute for detecting movement of the single copy of the newspaper through the dispensing chute, said sensor means transmitting a signal to the driving means to terminate advancement of the support plate and dispensing of a next copy of the newspaper when the single copy of the newspaper drops into the dispensing channel.

* * * * *